US008869805B2

(12) United States Patent
Wanna

(10) Patent No.: US 8,869,805 B2
(45) Date of Patent: Oct. 28, 2014

(54) FREE AIR BURNING SMOKING ARTICLES WITH REDUCED IGNITION PROCLIVITY CHARACTERISTICS

(75) Inventor: Joseph T. Wanna, Alpharetta, GA (US)

(73) Assignee: Schweitzer-Mauduit International, Inc., Alpharetta, GA (US)

( * ) Notice: Subject to any disclaimer, the term of this patent is extended or adjusted under 35 U.S.C. 154(b) by 838 days.

(21) Appl. No.: 11/809,802

(22) Filed: Jun. 1, 2007

(65) Prior Publication Data

US 2007/0295348 A1 Dec. 27, 2007

Related U.S. Application Data

(60) Provisional application No. 60/809,905, filed on Jun. 1, 2006.

(51) Int. Cl.
*A24D 1/02* (2006.01)

(52) U.S. Cl.
CPC ..... *A24D 1/025* (2013.01)
USPC ..... 131/365

(58) Field of Classification Search
CPC ..... A24D 1/025
USPC ..... 131/360, 365
See application file for complete search history.

(56) References Cited

U.S. PATENT DOCUMENTS

| | | | |
|---|---|---|---|
| 1,996,002 | A | 5/1933 | Seaman |
| 2,013,508 | A | 5/1933 | Seaman |
| 2,003,690 | A | 6/1935 | Lewton |
| 2,673,799 | A | 3/1954 | Schur et al. |
| 2,776,912 | A | 1/1957 | Gregory |
| 3,215,579 | A | 11/1965 | Hagen |
| 3,353,541 | A | 11/1967 | Hind et al. |
| 3,386,449 | A | 6/1968 | Hind |
| 3,415,253 | A | 12/1968 | Michels et al. |
| 3,420,241 | A | 1/1969 | Hind et al. |
| 3,428,053 | A | 2/1969 | Schoenbaum et al. |
| 3,467,109 | A | 9/1969 | Block et al. |

(Continued)

FOREIGN PATENT DOCUMENTS

| | | | |
|---|---|---|---|
| CA | 2319855 | A1 | 3/2000 |
| DE | 10146810 | A1 | 4/2003 |

(Continued)

OTHER PUBLICATIONS

International Search Report for Application No. PCT/US2007/012955, completed Oct. 23, 2007, mailed Oct. 30, 2007.

(Continued)

*Primary Examiner* — Michael J Felton
(74) *Attorney, Agent, or Firm* — Dority & Manning, P.A.

(57) ABSTRACT

Smoking articles having reduced ignition proclivity characteristics are disclosed. Smoking articles include a paper wrapper that is treated with a film-forming composition. The film-forming composition forms treated discrete areas on the wrapper. The treated discrete areas reduce ignition proclivity properties of the smoking article made with the wrapper. The film-forming composition contained a film-forming material blended with a burn promoting agent in the absence of a burn retardant. In one embodiment, for instance, the film-forming composition consists essentially of a film-forming material and a burn promoting agent. Various advantages and benefits are realized by blending a film-forming material with burn promoting agent without also incorporating a burn retardant into the composition.

29 Claims, 2 Drawing Sheets

(56) References Cited

U.S. PATENT DOCUMENTS

| | | | |
|---|---|---|---|
| 3,472,237 | A | 10/1969 | Stephens |
| 3,483,874 | A | 12/1969 | Hind |
| 3,511,247 | A | 5/1970 | Tamol |
| 3,526,904 | A | 9/1970 | Tamol |
| 3,561,451 | A | 2/1971 | Jacin et al. |
| 3,599,153 | A | 8/1971 | Lewis et al. |
| 3,620,801 | A | 11/1971 | O'Grady |
| 3,621,851 | A | 11/1971 | Heskett et al. |
| 3,699,973 | A | 10/1972 | Tamol et al. |
| 3,736,940 | A | 6/1973 | Saint-Pastou |
| 3,760,815 | A | 9/1973 | Deszyck |
| 3,805,799 | A | 4/1974 | Stewart et al. |
| 3,847,164 | A | 11/1974 | Mattina et al. |
| 3,860,012 | A | 1/1975 | Selke |
| 3,911,932 | A | 10/1975 | Houck, Jr. et al. |
| 3,949,762 | A | 4/1976 | West et al. |
| 4,077,414 | A | 3/1978 | Baker et al. |
| 4,129,134 | A | 12/1978 | Hind et al. |
| 4,140,760 | A | 2/1979 | Withington |
| 4,146,040 | A | 3/1979 | Cohn |
| 4,182,349 | A | 1/1980 | Selke |
| 4,193,412 | A | 3/1980 | Heim et al. |
| 4,222,740 | A | 9/1980 | Bohrn et al. |
| 4,239,591 | A | 12/1980 | Blake |
| 4,267,240 | A | 5/1981 | Jaisle et al. |
| 4,303,084 | A | 12/1981 | Simon |
| 4,351,638 | A | 9/1982 | Finlayson, III et al. |
| 4,386,108 | A | 5/1983 | Richter |
| 4,452,259 | A | 6/1984 | Norman et al. |
| 4,453,553 | A | 6/1984 | Cohn |
| 4,481,960 | A | 11/1984 | Brooks |
| 4,489,738 | A | 12/1984 | Simon |
| 4,543,370 | A | 9/1985 | Porter et al. |
| 4,590,955 | A | 5/1986 | Dixit |
| 4,607,647 | A | 8/1986 | Dashley et al. |
| 4,615,345 | A | 10/1986 | Durocher |
| 4,622,983 | A | 11/1986 | Mathews et al. |
| 4,665,648 | A | 5/1987 | Branco et al. |
| 4,674,519 | A | 6/1987 | Keritsis et al. |
| 4,679,575 | A | 7/1987 | Yamaguchi et al. |
| 4,739,775 | A | 4/1988 | Hampl, Jr. |
| 4,784,164 | A | 11/1988 | Adams et al. |
| 4,805,644 | A | 2/1989 | Hampl, Jr. et al. |
| 4,880,870 | A | 11/1989 | Zimmermann et al. |
| 4,889,145 | A | 12/1989 | Adams et al. |
| 4,928,715 | A | 5/1990 | Mentzel et al. |
| 4,945,932 | A | 8/1990 | Mentzel et al. |
| 4,984,589 | A | 1/1991 | Riedesser |
| 4,998,542 | A | 3/1991 | Kallianos et al. |
| 5,040,551 | A | 8/1991 | Schlatter et al. |
| 5,057,606 | A | 10/1991 | Garbe |
| 5,060,675 | A | 10/1991 | Milford et al. |
| 5,092,353 | A | 3/1992 | Montoya et al. |
| 5,106,417 | A | 4/1992 | Hauser et al. |
| 5,125,421 | A | 6/1992 | Mitchell |
| 5,131,416 | A | 7/1992 | Gentry |
| 5,143,099 | A | 9/1992 | Le Gars et al. |
| 5,144,966 | A | 9/1992 | Washington |
| 5,161,549 | A | 11/1992 | Rosario |
| 5,170,807 | A | 12/1992 | Kasbo et al. |
| 5,178,167 | A | 1/1993 | Riggs et al. |
| 5,220,930 | A | 6/1993 | Gentry |
| 5,221,502 | A | 6/1993 | Washington |
| 5,261,425 | A | 11/1993 | Raker et al. |
| 5,263,999 | A | 11/1993 | Baldwin et al. |
| 5,271,419 | A | 12/1993 | Arzonico et al. |
| 5,316,575 | A | 5/1994 | Lent et al. |
| 5,393,333 | A | 2/1995 | Trouve |
| 5,417,228 | A | 5/1995 | Baldwin et al. |
| 5,450,862 | A | 9/1995 | Baldwin et al. |
| 5,450,863 | A | 9/1995 | Collins et al. |
| 5,474,095 | A | 12/1995 | Allen et al. |
| 5,503,876 | A | 4/1996 | Fields et al. |
| 5,523,014 | A | 6/1996 | Dolan et al. |
| 5,540,242 | A | 7/1996 | Chao et al. |
| 5,690,787 | A | 11/1997 | Hultman et al. |
| 5,715,844 | A | 2/1998 | Young et al. |
| 5,722,433 | A | 3/1998 | Ishino et al. |
| 5,724,998 | A | 3/1998 | Gellatly et al. |
| 5,765,570 | A | 6/1998 | Litzinger et al. |
| 5,820,998 | A | 10/1998 | Hotaling et al. |
| 5,849,153 | A | 12/1998 | Ishino et al. |
| 5,878,753 | A | 3/1999 | Peterson et al. |
| 5,878,754 | A | 3/1999 | Peterson et al. |
| 5,893,372 | A | 4/1999 | Hampl, Jr. |
| 6,129,087 | A | 10/2000 | Wallace et al. |
| 6,286,516 | B1 | 9/2001 | Bowen et al. |
| 6,289,898 | B1 | 9/2001 | Fournier et al. |
| 6,298,860 | B1 | 10/2001 | Hampl et al. |
| 6,305,382 | B1 | 10/2001 | Hampl, Jr. |
| 6,314,964 | B1 | 11/2001 | Hampl, Jr. |
| 6,371,127 | B1 | 4/2002 | Snaidr |
| 6,568,403 | B2 | 5/2003 | Hampl, Jr. et al. |
| 6,606,999 | B2 | 8/2003 | Crooks et al. |
| 6,615,842 | B1 | 9/2003 | Cerami et al. |
| 6,637,439 | B2 | 10/2003 | Hajaligol et al. |
| 6,645,605 | B2 | 11/2003 | Hammersmith et al. |
| 6,679,270 | B2 | 1/2004 | Baskevitch et al. |
| 6,701,936 | B2 | 3/2004 | Shafer et al. |
| 6,705,325 | B1 | 3/2004 | Hicks et al. |
| 6,722,373 | B2 | 4/2004 | Bowen et al. |
| 6,725,867 | B2 | 4/2004 | Peterson et al. |
| 6,748,955 | B2 | 6/2004 | Snaidr et al. |
| 6,769,437 | B2 | 8/2004 | Hajaligol et al. |
| 6,779,530 | B2 | 8/2004 | Kraker |
| 6,799,578 | B2 | 10/2004 | Snaidr et al. |
| 6,810,884 | B2 | 11/2004 | Snaidr et al. |
| 6,823,872 | B2 | 11/2004 | Hampl, Jr. |
| 6,827,087 | B2 | 12/2004 | Wanna et al. |
| 6,837,248 | B2 | 1/2005 | Zawadzki et al. |
| 6,854,469 | B1 | 2/2005 | Hancock et al. |
| 6,860,274 | B2 | 3/2005 | Matsufuji et al. |
| 6,929,013 | B2 * | 8/2005 | Ashcraft et al. ..... 131/365 |
| 7,017,586 | B2 | 3/2006 | Tsutsumi et al. |
| 7,165,553 | B2 | 1/2007 | Luan et al. |
| 7,219,672 | B2 | 5/2007 | Tosas Fuentes et al. |
| 7,234,471 | B2 | 6/2007 | Fitzgerald et al. |
| 7,308,898 | B2 | 12/2007 | Monsalud, Jr. et al. |
| 7,600,518 | B2 | 10/2009 | Oglesby et al. |
| 2002/0139381 | A1 | 10/2002 | Peterson et al. |
| 2003/0136420 | A1 * | 7/2003 | Kraker ..... 131/360 |
| 2003/0145869 | A1 | 8/2003 | Kitao et al. |
| 2003/0150466 | A1 | 8/2003 | Kitao et al. |
| 2003/0164173 | A1 | 9/2003 | Zawadzki et al. |
| 2004/0007242 | A1 | 1/2004 | Finlay et al. |
| 2004/0020504 | A1 | 2/2004 | Snaidr et al. |
| 2004/0123874 | A1 | 7/2004 | Zawadzki et al. |
| 2004/0182407 | A1 | 9/2004 | Peterson et al. |
| 2004/0255966 | A1 | 12/2004 | Kraker |
| 2005/0005947 | A1 | 1/2005 | Hampl, Jr. et al. |
| 2005/0056294 | A1 | 3/2005 | Wanna et al. |

FOREIGN PATENT DOCUMENTS

| | | | |
|---|---|---|---|
| EP | 0231664 | A1 | 8/1987 |
| EP | 0290911 | A2 | 11/1988 |
| EP | 0419975 | A2 | 4/1991 |
| EP | 0419975 | A3 | 4/1991 |
| EP | 0458526 | A1 | 11/1991 |
| EP | 0486213 | A1 | 5/1992 |
| EP | 0601933 | A2 | 6/1994 |
| EP | 0671505 | A2 | 9/1995 |
| EP | 0262550 | A1 | 4/1998 |
| EP | 864259 | A2 | 9/1998 |
| EP | 0864259 | A2 | 9/1998 |
| EP | 0870437 | A2 | 10/1998 |
| EP | 1084629 | A1 | 3/2001 |
| EP | 1417899 | A1 | 5/2004 |
| FR | 2470598 | A1 | 6/1981 |
| FR | 2548675 | A1 | 1/1985 |
| GB | 848332 | | 8/1956 |
| GB | 903067 | | 8/1962 |
| GB | 2100572 | | 1/1983 |
| WO | WO 81/02243 | A1 | 8/1981 |

(56) References Cited

FOREIGN PATENT DOCUMENTS

| | | | |
|---|---|---|---|
| WO | WO 01/14729 | | 10/1991 |
| WO | WO 88/01478 | A | 3/1998 |
| WO | WO 98/16125 | A1 | 4/1998 |
| WO | WO 99/53778 | A2 | 10/1999 |
| WO | WO 00/11976 | A1 | 3/2000 |
| WO | WO 01/41590 | A1 | 6/2001 |
| WO | WO 02/37991 | A1 | 5/2002 |
| WO | WO 02/43513 | A1 | 6/2002 |
| WO | WO 02/067704 | A1 | 9/2002 |
| WO | WO 02/078471 | A1 | 10/2002 |
| WO | WO 03/034845 | A1 | 5/2003 |
| WO | WO 03/064165 | A1 | 8/2003 |
| WO | WO 03/088771 | A1 | 10/2003 |
| WO | WO 03/092416 | A1 | 11/2003 |

OTHER PUBLICATIONS

Publication, "Determination of paper filler Z—distribution by Low Vacuum SEM and EDX", Roux et al., Journal of Microscopy, (online) vol. 229, No. 1, Dec. 17, 2007, abstract.

Publication, "Determination of Paper Filler Z—distribution by Low Vacuum SEM and EDX", Roux et al., Journal of Microscopy, (online) vol. 229, No. 1, Dec. 17, 2007, pp. 44-45.

International Search Report PCT/US2007/012955, completed Oct. 23, 2007, mailed Oct. 30, 2007.

International Search Report PCT/US2009/033188, completed Feb. 5, 2009, mailed Aug. 28, 2009.

International Search Report PCT/US2008/069149, completed Jul. 3, 2008, mailed Jan. 5, 2009.

International Search Report PCT/US2008/069149, completed Jul. 3, 2008, mailed May 14, 2009.

Product Data Sheet for Mapico® High-Purity Synthetic Iron Oxide Yellow 1135, Aug. 16, 2001.

Annex to Form PCT/ISA/206 for PCT/US2004/013656, Dec. 22, 2004.

Program Booklet and Abstracts, vol. 57, 57th Tobacco Science Research Conference, Sep. 21-24, 2003, Norfolk, Virginia, 2 pages.

Abstract of Article—The effect of tobacco ingredients on smoke chemistry. Part I: Flavourings and additives, R. R. Baker, Silva de Pereira, Jr., and G. Smith, Food Chem. Toxicol., vol. 42, 2004, Suppl:S3-37, 2 pages.

Hoffmann, Dietrich and Hoffmann, IISE (1997), The Changing Cigarette, 1950-1995, Mar. 1997, Journal of Toxicology and Environmental Health, Part A, 50:4, 307-364 (DOI: 10.1080/009841097160393) URL: http://dx.doi.org/10.1080/009841097160393.

MacEvoy, Bruce, Synthetic Inorganic Pigments, Jul. 2008, www.handprint.com/HP/WCL/pigmt1b.ntml, accessed Nov. 16, 2010.

Publication, "Cigarette Ignition Performance", J.T. Wanna and P.X. Chen, Journal of Fire Sciences, vol. 19, Sep./Oct. 2001, pp. 355-368.

German Standard, DIN ISO 2965, Materials used as cigarette papers, filter plug wrap and filter joining paper, including materials having an oriented permeable zone—Determination of air permeability, Jan. 2000, 19 pages.

* cited by examiner

FREE AIR BURNING SMOKING ARTICLES WITH REDUCED IGNITION PROCLIVITY CHARACTERISTICS

RELATED APPLICATIONS

The present application is based upon and claims priority to U.S. Provisional Patent Application Ser. No. 60/809,905 filed on Jun. 1, 2006.

BACKGROUND

There is an ongoing concern in the tobacco industry to produce cigarettes having wrappers which reduce the ignition proclivity of the smoking article, or the tendency of the smoking article to ignite surfaces which come into contact with the lit smoking article. Reports have been made of fires attributed to burning cigarettes coming into contact with combustible materials. A justifiable interest exists in the industry to reduce the tendency of cigarettes, or other smoking articles to ignite surfaces and materials used in furniture, bedding, and the like upon contact.

Thus, a desirable feature of smoking articles, particularly cigarettes, is that they self-extinguish upon being dropped or left in a free burning state on combustible materials.

It has long been recognized in the tobacco industry that the cigarette wrapper has a significant influence on the smolder characteristics of the cigarette. In this regard, various attempts have been made in the art to alter or modify the cigarette wrappers in order to achieve the desired tendency of the cigarette to self-extinguish, or in other words to reduce the ignition proclivity characteristics of cigarettes.

The prior art describes the application of film-forming solutions to cigarette paper to reduce the paper permeability and control the burn rate. It has been shown that when these materials have been applied in discrete areas along the length of the cigarette, the cigarette shows a reduced propensity to ignite a substrate, tends to self-extinguish, and has a higher puff count.

U.S. Pat. No. 5,878,753 to Peterson and U.S. Pat. No. 5,820,998 to Hotaling, et al. which are incorporated herein by reference, for example, describe a smoking article wrapper being treated with a film-forming aqueous solution to reduce permeability. U.S. Pat. No. 5,878,754 to Peterson which is also incorporated herein by reference describes a smoking article wrapper being treated with a non-aqueous solution of a solvent soluble polymer dissolved in a non-aqueous solution to reduce permeability.

Although many improvements have been made in the art, there is still a need for an improved method for producing a cigarette wrapper with reduced ignition proclivity properties. For example, problems have been experienced in producing a smoking article that self extinguishes when left burning on an adjacent surface but does not self extinguish when left in a free air burning state, such as when a cigarette is being held and not puffed or when a cigarette is propped in a ashtray. Specifically, problems have arisen in designing smoking articles as described above on a repetitive basis.

Another problem that has been experienced in designing smoking articles with reduced ignition proclivity characteristics is that the treated areas on the smoking articles have a tendency to adversely affect the taste and enjoyment of the article. For example, typically the smoking articles include a paper wrapper having treated areas separated by untreated areas. The smoke components and the taste of the article has a tendency to change as a burning coal advancing along the article advances from an untreated area to a treated area.

Likewise, problems have also been experienced in controlling the ash properties of the smoking articles. In general, a white and cohesive ash is desired. The ash characteristics, however, have a tendency to change as the burning coal advances from an untreated area to a treated area. A need currently exists for a paper wrapper that not only reduces the ignition proclivity characteristics of a smoking article but also does so without substantially affecting the ash characteristics of the article.

SUMMARY

The present disclosure is generally directed to paper wrappers for smoking articles with reduced ignition proclivity and to a process for making the wrappers. For example, in one embodiment, the paper wrapper can be made from a paper web. For example, the paper wrapper can contain flax fibers, softwood fibers, hardwood fibers and mixtures thereof. The paper wrapper can also include a filler, such as calcium carbonate or a magnesium oxide, in an amount from about 10% to about 40% by weight.

A film-forming composition is applied to the paper wrapper at particular locations. The film-forming composition form treated discrete areas on the wrapper. The discrete areas are separated by untreated areas. The treated discrete areas are configured to reduce ignition proclivity of a smoking article incorporating the wrapper. For example, the treated areas can reduce ignition proclivity by reducing oxygen to a smoldering coal of the smoking article as the coal burns and advances into the treated areas.

In accordance with the present disclosure, the film-forming composition contains a film-forming material blended with a burn promoting agent but being free of a burn retardant. The present inventor has found various advantages and benefits to blending a burn promoting agent and a film-forming material in the absence of a burn retardant. For instance, such a combination allows better control over the burn properties of a resulting smoking article. In particular, treated areas on a paper wrapper in accordance with the present invention can be constructed so that the smoking article self extinguishes when left burning against an adjacent surface, but yet will not self extinguish if left burning in a free air state. In addition to having better control over the burn properties, the combination of the film-forming composition and the burn promoting agent improves the taste and uniformity of the smoking article, especially when compared to other formulations where a burn retardant is present. Finally, the blend can also improved the ash properties of the smoking article and reduces spotting in the banded areas.

The film-forming material can be, for instance, an alginate, such as sodium or potassium alginate. It should be understood, however, that various other film-forming materials can be used. Other film-forming materials that are believed to be useful in the present invention include guar gum, pectin, polyvinyl alcohol, polyvinyl acetate, cellulose derivatives such as ethyl cellulose, methyl cellulose, carboxymethyl cellulose, starch, and starch derivatives.

The burn promoting agent blended with the film-forming material can be, for instance, an alkali metal salt or an alkaline earth metal salt. In one particular embodiment, for instance, a carboxylic acid salt may be used. Particular examples of burn promoters that may be used in various embodiments include an acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, or mixtures thereof. The burn promoter may be present in the film-forming composition in an amount from about 0.1% to about 5% by weight, such as from about 1% to about 3% by weight.

In one particular embodiment, the film-forming composition may comprise a blend of an alginate with a citrate, a succinate, or a mixture of a citrate and a succinate.

The film-forming composition can be applied to the paper wrapper according to various methods. For example, the composition can be printed onto the paper using, for instance, flexography, direct gravure printing, and offset gravure printing.

In one embodiment, the discrete areas formed by the film-forming composition are in the shape of circumferential bands disposed longitudinally along the smoking article. The bands can have a width of greater than about 3 mm, such as from about 4 mm to about 10 mm.

The bands can be spaced from each other at a distance of from about 5 mm to about 50 mm and particularly from about 10 mm to about 40 mm.

The amount of the film-forming composition that is applied to the paper wrapper depends upon the particular application and various factors. For example, the film-forming composition can be applied to the wrapper in an amount from about 1% to about 30% by weight based upon the weight of the wrapper within the treated areas, and particularly in an amount from about 2% to about 20% by weight.

Once applied to the paper wrapper, the treated areas can have a permeability of less than about 40 Coresta, particularly less than about 30 Coresta, and more particularly from about 5 Coresta to about 25 Coresta. The initial permeability of the paper wrapper can be from about 20 Coresta to about 110 Coresta or greater. For example, the initial permeability of the paper wrapper may be greater than about 60 Coresta, such as greater than about 80 Coresta.

In addition to containing a film-forming material and a burn-promoting agent, the film-forming composition may include various other ingredients. For example, in one embodiment, the film-forming composition may contain a particulate inorganic filler.

The film-forming composition when applied to the paper wrapper may be contained in an aqueous solution or may be contained in a non-aqueous solution. When contained in a non-aqueous solution, for example, an alcohol may be present. As described above, however, particular advantages and benefits of the present invention are achieved when the film-forming composition does not contain a burn retardant as described in greater detail below.

Once the film-forming composition is applied to the paper wrapper, the paper wrapper within the discrete areas may have a Burn Mode Index within a particular range that indicates reduced ignition proclivity characteristics. The Burn Mode Index (hereinafter BMI), for example, may be less than about 5 $cm^{-1}$, such as less than about 3 $cm^{-1}$.

The paper wrapper may have any suitable basis weight depending upon a particular application. In one particular embodiment, for instance, the paper wrapper may have a basis weight of from about 18 gsm to about 60 gsm. In addition to containing a first burn promoting agent within the treated areas, the paper wrapper may also be treated with a second burn promoting agent over substantially the entire surface area of the paper wrapper. For example, the second burn promoting agent may be applied to the paper wrapper prior to or after the treated areas are formed. The second burn promoting agent may be applied to the paper wrapper in amounts from about 0.1% to about 3% by weight. The second burn promoting agent may be the same or different from the first burn promoting agent that is blended with the film-forming material.

Other features and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figures in which.

Figure 1:
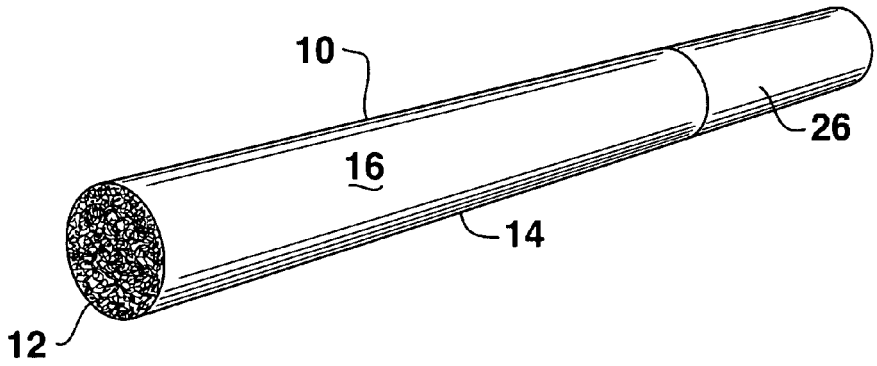
FIG. 1 is a perspective view of a smoking article made in accordance with the present invention.

Repeat use of reference characters in the present specification and drawings is intended to represent same or analogous features or elements of the present invention.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations.

For purposes of explanation of the invention, the embodiments and principles of the invention will be discussed in regards to a cigarette. However, this is for the purposes of explanation of the invention only and is not meant to limit the invention only to cigarettes. Any manner of smoking article is within the scope and spirit of the invention.

The present disclosure relates to a smoking article, and a wrapper for a smoking article, having improved ignition proclivity control characteristics. "Ignition proclivity" is a measure of the tendency of the smoking article or cigarette to ignite a flammable substrate if the burning cigarette is dropped or otherwise left on a flammable substrate. A test for ignition proclivity of a cigarette has been established by NIST (National Institute of Standards and Technology) and is generally referred to as the "Mock-Up Ignition Test". The test comprises placing a smoldering cigarette on a flammable test fabric and recording the tendency of the cigarette to either ignite the test fabric, burn the test fabric beyond a normal char line of the cigarette, burn its entire length without igniting the fabric, or self-extinguish before igniting the test fabric or burning its entire length.

Another test for ignition proclivity is referred to as the "Cigarette Extinction Test". The Cigarette Extinction Test is ASTM Test No. E2187-04. In the Cigarette Extinction Test, a lit cigarette is placed on ten layers of filter paper. If the cigarette self extinguishes, the cigarette passes the test. If the cigarette burns all the way to its end on the filter, however, the cigarette fails. Smoking articles made in accordance with the present invention can be designed to pass one or both of these tests.

In addition to the above tests, smoking articles having reduced ignition proclivity cigarettes are typically also tested for "free air self-extinguishment" (FASE). During the free air extinguishment test, the smoking articles are allowed to burn in the free air without being puffed and without being placed on an adjacent surface. In most applications, it is desirable for a smoking article to pass the mock up ignition test or the cigarette extinction test while not self-extinguishing when left burning in the free air. Thus, lower FASE rates are preferred. Of particular advantage, smoking articles constructed in accordance with the principles of the present invention may be configured to self extinguish when placed on an adjacent surface but yet have lower FASE rates in comparison to prior products that are intended to have reduced ignition proclivity characteristics.

In general, smoking articles having reduced ignition proclivity are made according to the present invention by applying in discrete areas to a wrapping paper a film-forming composition. The film-forming composition contains a film-forming material blended with a burn promoting agent. Further, in addition to blending the burn-promoting agent with the film forming material prior to application to the paper wrapper, the film-forming composition is also free of any burn retardant. The present inventor has discovered that various benefits and advantages are achieved when combining a burn promoting agent with a film-forming material in the absence of a burn retardant.

In the past, the assignee of the present application has obtained various patents directed to smoking articles with reduced ignition proclivity characteristics. For example, paper wrappers treated with a film-forming composition that forms treated discrete areas on the wrapper are disclosed in U.S. Pat. Nos. 6,779,530 and 6,725,867, which are both incorporated herein by reference. The '530 patent, for instance, also discloses that the wrapping paper may be treated with a burn control additive such as an alkali metal salt, an acetate, or a phosphate salt. The burn control additive, however, was applied over substantially the entire surface area of the paper wrapper and was not intimately incorporated into the film-forming composition prior to application to the paper.

Further, U.S. Pat. No. 6,837,248 discloses a reduced ignition propensity smoking article which discloses a wrapper that includes at least one discrete area treated with a composition to reduce the base permeability. The composition of the treated area includes a permeability reducing substance, a burn rate accelerating substance, and a burn rate retarding substance. The burn rate retarding substance is a substance that reduces the smolder rate of materials such as paper, cloth, and plastic and that increases the resistance of the materials to flaming combustion. Examples of burn rate retarding substances disclosed in the '248 patent include phosphates of ammonium, such as diammonium phosphate, which is also known as DAP.

The present inventor, however, has discovered unexpectedly in view of the teachings of the '248 patent that various advantages and benefits are achieved when a burn retardant is not present in a film-forming composition comprising a film-forming material blended with a burn promoting agent. For example, the present inventor has found that by only including a film-forming material blended with a burn promoting agent, better control over the burn properties of a smoking article incorporating a treated wrapper results. In particular, while having reduced ignition proclivity characteristics, such smoking articles have a reduced tendency to self extinguish in free air when not being puffed.

In addition, a burn retardant may adversely affect the taste of the smoking article. Blending a burn promoting agent with a film-forming material has been found to produce smoking articles that, when puffed through the treated areas, have a more pleasant or neutral taste. Further, the taste is more uniform when either the smoking article is puffed in an untreated area or in a treated area.

The above advantages are especially enhanced when the burn promoting agent is intimately mixed with the film-forming material prior to application to the paper wrapper as opposed to applying the materials in separate steps.

In addition to the above, smoking articles made in accordance with the present invention have also been found, in some applications, to have improved ash properties. For instance, an ash produced by a smoking article made in accordance with the present invention may have a relatively white color, is cohesive, and is less likely to change in color or consistency when the lit coal burns through the treated areas and the untreated areas of the wrapper.

Similarly, the blended combination of a film-forming material and a burn promoting agent without the presence of a burn retardant has found to reduce spotting in the treated areas as the burning coal approaches the treated areas.

It is believed that the general principles of the present invention can be used in conjunction with any suitable film-forming material in producing a film-forming composition. For example, film-forming materials that can be used in accordance with the present invention include alginates, guar gum, pectin, polyvinyl alcohol, polyvinyl acetate, cellulose derivatives such as ethyl cellulose, methyl cellulose, and carboxymethyl cellulose, starch, starch derivatives, and the like.

In one particular embodiment, the film-forming material may comprise an alginate. In general, an alginate is a derivative of an acidic polysaccaride or gum which occurs as the insoluble mixed calcium, sodium, potassium and magnesium salt in the Phaeophyceae brown seaweeds. Generally speaking, these derivatives are calcium, sodium, potassium, and/or magnesium salts of high molecular weight polysaccarides composed of varying proportions of D-mannuronic acid and L-guluronic acid. Exemplary salts or derivatives of alginic acid include ammonium alginate, potassium alginate, sodium alginate, propylene glycol alginate, and/or mixtures thereof.

In one embodiment, a relatively low molecular weight alginate may be used. For example, the alginates may have a viscosity of less than about 500 cP when contained in a 3% by weight aqueous solution at 25° C. More particularly, the alginates may have a viscosity of less than 250 cP at the above conditions, particularly less than 100 cP, and in one embodiment at a viscosity of about 20-60 cP. As used herein, viscosity is determined by a Brookfield LVF Viscometer. Commercially available alginates that may be used include KELGIN RL, MANUCOL LD AND MANUCOL LB, which are all commercially available from the ISP Corporation.

At the above lower viscosity levels, alginate compositions can be formed at a higher solids content, but yet at a low enough solution viscosity to permit the application of the composition to a paper wrapper using conventional techniques. For example, the solids content of an alginate solution made in accordance with the present invention can be greater than about 6%, particularly greater than about 10%, and more particularly from about 10% to about 20% by weight.

At the above solids levels, alginate compositions used in accordance with the present invention can have a solution viscosity of greater than about 250 cP, particularly greater than about 500 cP, more particularly greater than about 800 cP, and in one embodiment at a viscosity of greater than about 1,000 cP at 25° C. In general, the solution viscosity of the alginate film-forming composition can be adjusted depending upon the manner in which the composition is being applied to the paper. For instance, the solution viscosity of the composition can be adjusted depending upon whether or not the composition is being sprayed onto the paper or printed onto the paper.

In other embodiments, it should also be understood that depending upon the application a relatively high molecular weight alginate may be used. For example, the alginate may have a viscosity of greater than about 500 cP when contained in a 3% by weight aqueous solution at 25° C.

The burn promoting agent that is combined and blended with the film forming material prior to application to the wrapper may comprise any suitable substance that enhances the burn rate. Examples of burn promoting agents include alkali metal salts, alkaline earth metal salts, and mixtures thereof. In one embodiment, the burn promoting agent may comprise a salt of a carboxylic acid. In particular examples, for instance, the burn promoting agent may comprise an acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, and mixtures thereof. In one particular application, for instance, the burn promoting agent may comprise potassium citrate, sodium citrate, potassium succinate, sodium succinate, or mixtures thereof.

In addition to the film-forming material and the burn promoting agent, the film-forming composition applied to the paper wrapper can contain various other ingredients as long as the composition does not contain a burn retardant.

For instance, in one embodiment, a filler can be contained within the composition. The filler can be, for instance, calcium carbonate, calcium chloride, calcium lactate, calcium gluconate, and the like. In addition to calcium compounds, other metal compounds can also be included, including similar magnesium compounds.

The film-forming composition, in one embodiment, can be water based. In particular, the film-forming composition may comprise an aqueous dispersion or aqueous solution. Alternatively, the film-forming composition prior to being applied to the paper wrapper may comprise a non-aqueous solution or dispersion. In this embodiment, for instance, an alcohol may be present for applying the composition to the wrapper.

Once the film-forming composition is formulated, the composition is applied to a paper wrapper in discrete areas. The manner in which the composition is applied to the paper wrapper can vary. For example, the composition can be sprayed, brushed or printed onto the wrapper. To form a treated area, the composition can be applied in a single pass or in a multiple pass operation. For instance, the composition can be applied to the wrapping paper in successive steps in order to form areas on the paper having reduced ignition proclivity. In general, during a multiple pass process, the treated areas can be formed by applying the composition during from about 2 to about 8 passes.

Figure 2:
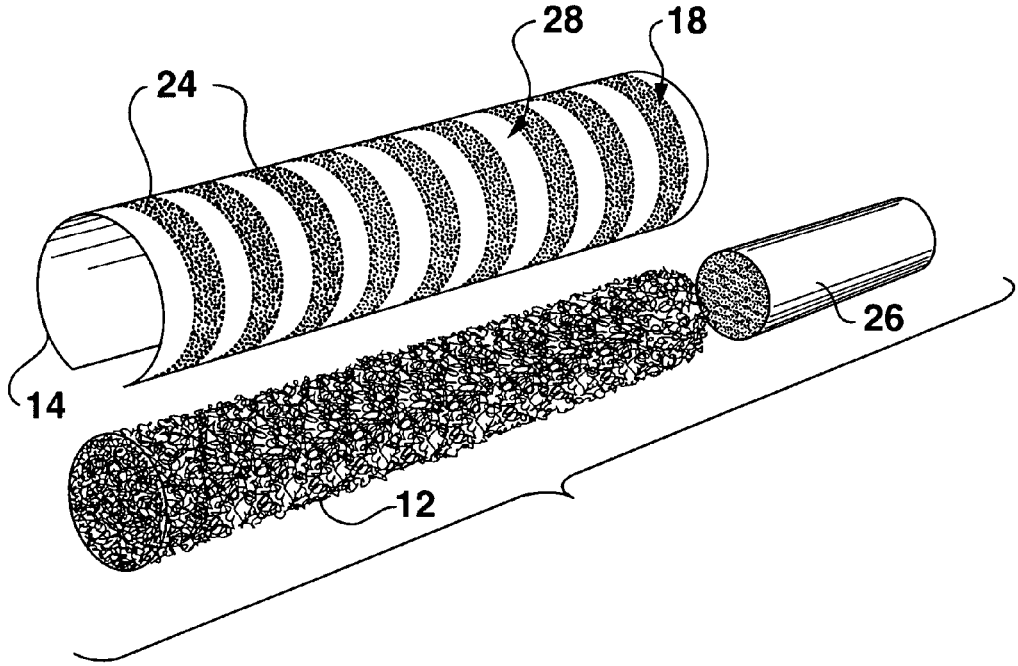
FIG. 2 is an exploded view of the smoking article illustrated in FIG. 1.

In order to assist in describing and explaining the present invention, one embodiment of the invention is illustrated generally in FIGS. 1 and 2. A smoking article (cigarette), generally 10, having improved ignition proclivity characteristics includes a tobacco column 12 within a wrapper 14. Article 10 may include a filter 26. Wrapper 14 may include any manner of commercially available cigarette wrapper.

Generally, the wrapping paper can be made from cellulosic fibers obtained, for instance, from flax, softwood or hardwood. In order to vary the properties of the paper as desired, various mixtures of cellulosic fibers can be used. The extent to which the fibers are refined can also be varied.

For most applications, the paper wrapper will contain a filler. The filler can be, for instance, calcium carbonate, magnesium oxide, or any other suitable material. The total filler loading added to the paper wrapper can be between about 10% to about 40% by weight.

The permeability of a paper wrapper for smoking articles made according to the present invention can generally be from about 10 Coresta units to about 200 Coresta units. In some applications, the permeability can be between about 15 Coresta units to about 55 Coresta units. In one embodiment of the present invention, however, the initial permeability of the paper wrapper is relatively high. For instance, in one embodiment, the permeability of the paper wrapper can be from about 60 Coresta units to about 110 Coresta units. In various embodiments, for example the initial permeability of the paper wrapper may be greater than about 70 Coresta units, greater than about 80 Coresta units, greater than about 90 Coresta units, or greater than about 100 Coresta units.

The basis weight of cigarette wrapping paper is usually between about 18 gsm to about 60 gsm, and more particularly between about 15 gsm to about 40 gsm. Wrapping papers according to the present invention can be made within any of these ranges.

In addition to having the first burn promoting agent contained within the film-forming composition, in one embodiment, the paper wrapper may be treated with a second burn promoting agent. The second burn-promoting agent, for example, may be applied over substantially the entire surface area of the wrapping paper, especially over the surface area of the wrapping paper where the treated areas are located including the untreated areas spaced between the treated areas. The second burn promoting agent may comprise the same material as the first burn promoting agent. For example, the second burn promoting agent may be for instance an alkali metal salt, such as an acetate, a citrate, or a succinate. The second burn promoting agent may be applied relatively uniformly over the surface area of the paper wrapper in an amount from about 0.3% to about 5% by weight, such as from about 0.3% to about 2.5% by weight. The second burn promoting agent may be applied to the wrapper prior to or after the treated areas are formed on the wrapper using the film forming composition.

The second burn promoting agent may be applied to the wrapper for various reasons. For example, the second burn promoting agent may be applied so as to further control the burn properties of the wrapper, especially in the untreated areas on the wrapper. The second burn promoting agent may also serve as an ash conditioner.

In one alternative embodiment of the present invention, the second burn promoting agent may be applied to the paper wrapper in the untreated areas only. In this embodiment, the second promoting agent may be applied in amounts as specified above within the untreated areas.

Paper web 14 defines an outer circumferential surface 16 when wrapped around tobacco column 12. Discrete areas 18 of outer circumferential surface 16 are treated with a film-forming composition made in accordance with the present invention, such as an alginate composition blended with a burn promoting agent. It should also be understood that treated areas 18 could also be disposed on the inner surface of wrapper 14. In other words, wrapper 14 could be rolled around tobacco column 12 so that treated areas 18 are adjacent to the tobacco.

In the embodiment illustrated in FIGS. 1 and 2, treated areas 18 are defined as circumferential cross-directional bands 24. Bands 24 are spaced apart from each other longitudinally along the length of cigarette 10. The bands 24 are indicated in phantom in FIG. 2. However, it should be understood that the treated areas are essentially invisible in the formed cigarette as shown in FIG. 1. In other words, a smoker may not discern from any outward sign that the wrapper 14 has been treated in discrete areas 18. In this regard, treated areas 18 have a smooth and flat texture essentially the same as untreated areas 28.

The width and spacing of bands 24 are dependent on a number of variables, such as the initial permeability of wrapper 14, density of tobacco column 12, etc. The bands 24 preferably have a width so that oxygen is limited to the burning coal for a sufficient length or period of time to extinguish the coal. In other words, if band 24 were too narrow, the burning coal would burn through band 24 before self-extinguishing. For most applications, a minimum band width of 3 mm is desired. For example, the band width can be from about 4 mm to about 10 mm.

The spacing between bands 24 is also a factor of a number of variables. The spacing should not be so great that the cigarette burns for a sufficient length of time to ignite a substrate before the coal ever burns into a treated area 18. The spacing between bands 24 also affects the thermal inertia of the burning coal, or the ability of the coal to burn through the treated bands 24 without self-extinguishing. In the cigarettes tested, applicants have found that a band spacing of between 5 and 50 mm is appropriate and particularly between about 10 mm and 40 mm. However, it should be understood that the band spacing can be any suitable width as determined by any number of variables. For most applications, the smoking article can contain from 1 to about 3 bands using the above spacing.

Treated areas 18 have a permeability within a range which is known to provide improved ignition proclivity characteristics for the make-up of cigarette 10. As the coal of cigarette 10 burns into treated areas 18, oxygen available to the burning coal is substantially reduced due to the decreased permeability of wrapper 14 in the treated areas. The reduction of oxygen preferably causes the cigarette to self-extinguish in the treated areas 18 when in contact with a substrate. The permeability, for instance, may be less than 40 ml/min/cm$^2$ (CORESTA), particularly less than 30 ml/min/cm$^2$, and generally within a range of 5 to 25 ml/min/cm$^2$.

Besides permeability, another measurement that can be used to indicate reduced ignition proclivity properties is Burn Mode Index. In fact, the Burn Mode Index of a paper wrapper can be more accurate in indicating the burning characteristics of a paper as opposed to simply measuring the permeability of the paper. The test for determining Burn Mode Index is explained in U.S. Pat. No. 4,739,775 to Hampl, which is incorporated herein by reference.

In order to exhibit reduced ignition proclivity properties, the Burn Mode Index ("BMI") of the treated areas 18 can be generally less than about 8 cm$^{-1}$, and particularly less than about 5 cm$^{-1}$. For instance, in one embodiment, the burn mode index of the treated areas 18 can be from about 1 cm$^{-1}$ to about 3 cm$^{-1}$.

The amount of composition that is added to the paper will depend upon various factors, including the type of composition that is used and the desired result. For most applications, the film-forming composition, can be added to the paper in an amount from about 1% to about 30% by weight of the paper within the banded region, and particularly from about 2% to about 20% by weight of the paper within the banded region after the bands have been formed and dried. Although not always the case, generally the amount of the composition applied to the paper will generally increase as the permeability of the paper increases. For instance, for wrapping papers having a permeability of less than about 30 Coresta units, the composition can be applied to a paper in an amount from about 1% to about 15% by weight. For wrapping papers having a permeability greater than about 60 Coresta units, on the other hand, the composition can be applied to the paper in an amount from about 8% to about 30% by weight.

The amount of burn promoting agent contained within the treated areas may also vary depending upon various factors including the particular application, the base permeability of the paper, the film-forming material used, and the burn promoting agent that is selected. In general, for example, the burn promoting agent may be present within the treated areas in an amount from about 0.1% to about 5% by weight, such as from about 1 % to about 3% by weight of the solution composition.

Figure 3:
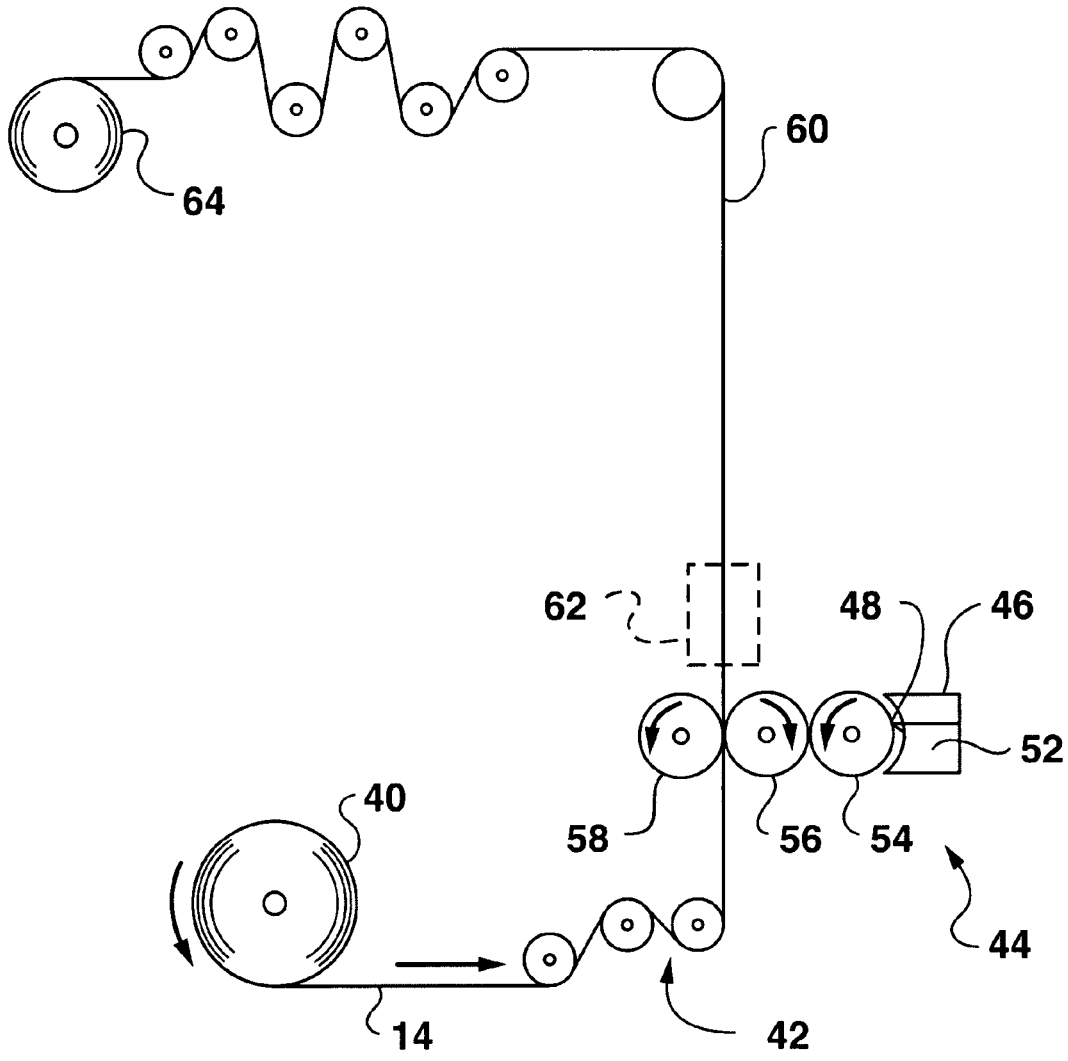
FIG. 3 is a system for treating a paper wrapper in accordance with the present invention.

As described above, the composition can be sprayed, brushed, or printed onto the wrapper. In general, any suitable printing process can be used in the present invention. Applicants have found that suitable printing techniques include gravure printing, or flexographic printing. In one embodiment, as illustrated in FIG. 3, a paper layer 14 is unwound from a supply roll 40 and travels in the direction indicated by the arrow associated therewith. Alternatively, the paper layer 14 may be formed by one or more paper-making processes and passed directly into the process 50 without first being stored on a supply roll 40.

As shown in FIG. 3, the paper layer 14 passes through the nip of an S-roll arrangement 42 in a reverse-S path. From the S-roll arrangement 42, the paper layer 14 passes to a gravure printing arrangement 44. The gravure printing process may be a direct print process or an indirect print process, such as by using an offset printer. FIG. 3 depicts an indirect print process.

The gravure printing arrangement contains a composition tank 46 and a doctor blade 48 which is used to apply a composition 52 to a gravure roll 54.

The gravure roll 54 may be engraved with a conventional continuous cell pattern (e.g., quadrangular cell pattern) arranged in parallel bands across the width of the roll with nonengraved areas between each band. Each gravure cell holds a small amount of the composition which is released in a pattern onto a rubber applicator roll 56. The paper layer 14 passes through a nip between the rubber applicator roll 56 and a cooperating backup roll 58. The composition is transferred from the applicator roll 56 to the surface of the paper layer 14 thereby forming a coated paper 60. The speeds of the gravure roll 54 and the applicator roll 58 may be controlled so they are the same or so they differ by a minor amount to influence the application of the composition. Once the composition is applied to the paper layer 14, the paper layer can be dried if desired.

For instance, as shown in FIG. 3, after leaving the gravure printing arrangement 44, the paper web 14 is passed through a drying operation 62. During the drying operation 62, the treated paper can be dried using various devices and methods. For example, in one embodiment, the drying operation 62 includes a drying device that passes hot gas such as air over the paper web. The temperature of the air can range from about 100° F. to about 600° F. In an alternative embodiment, the drying device can be a steam can. After being treated with a composition by the gravure printing device, the paper web can be placed in contact with the steam can for drying the composition.

Besides drying the paper with a hot gas stream or with a steam can, in another embodiment of the present invention the paper can be dried by contacting the paper with infra-red rays.

For example, in one embodiment, the paper can be passed under an infra-red heating lamp.

In still another alternative embodiment of the present invention, the paper web 14 can be simply air dried during the drying operation 62.

It should be understood that the process illustrated in FIG. 3 represents merely one embodiment for applying a composition to the paper wrapper. For instance, a greater amount of printing stations may be included at any location for applying the composition in a multi-pass process.

EXAMPLE

The following example demonstrates some of the features and advantages of the present disclosure.

A coating solution was formulated containing alginate and potassium citrate. Potassium citrate was present in the solution in an amount of 1% by weight. The alginate used was KELGIN alginate obtained from ISP Corporation and was contained in the solution at 12% solids.

The coating solution was printed onto a wrapping paper having a basis weight of 25 gsm and having a base permeability of 50 Coresta. The coating solution was applied to the wrapper in bands. The wrapper was then used to construct smoking articles.

Control smoking articles were also produced as described above, except the coating solution applied to the control did not contain the potassium citrate.

The smoking articles were then tested according to the Cigarette Extinction Test (ASTM E2187-04) and according to the Free Air Extinguishment (FASE) Test.

The smoking articles made according to the present disclosure gave a 95% pass rating on the Cigarette Extinction Test and gave a 30% result on the Free Air Extinguishment Test. The control smoking articles, on the other hand, produced an 87.5% rating on the Cigarette Extinction Test and a 55% result for the Free Air Extinguishment Test.

In addition, the ash produced during the examples was much whiter and coherent for the smoking articles made according to the present disclosure in comparison to the control samples.

These and other modifications and variations to the present invention may be practiced by those of ordinary skill in the art, without departing from the spirit and scope of the present invention. In addition, it should be understood that aspects of the various embodiments may be interchanged both in whole or in part. Furthermore, those of ordinary skill in the art will appreciate that the foregoing description is by way of example only, and is not intended to limit the invention.

What is claimed:

1. A smoking article having reduced ignition proclivity characteristics produced by a process comprising the steps of:

providing an untreated paper wrapper;

treating discrete areas of the paper wrapper by directly applying a film-forming composition to the discrete areas of the paper wrapper, the film-forming composition comprising a film-forming material and a first burn promoting agent, the film-forming composition being free of a burn retardant;

applying a second burn promoting agent only to untreated areas of the paper wrapper, the untreated areas being free of the film-forming composition;

wherein the treated areas containing the film-forming composition are separated by the untreated areas containing the second burn promoting agent, the treated areas having a permeability within a range sufficient to reduce ignition proclivity, the film-forming material comprising a material selected from the group consisting of an alginate, a guar gum, a pectin, a polyvinyl alcohol, a cellulose derivative, a starch, a starch derivative, and mixtures thereof; and wrapping the paper wrapper around a column comprising a smokable tobacco.

2. A smoking article as produced by the process of claim 1, wherein the alginate is sodium alginate.

3. A smoking article as produced by the process of claim 1, wherein the first burn promoting agent and the second burn promoting agent comprise a material selected from the group consisting of an alkali metal salt, an alkaline earth metal salt, and mixtures thereof.

4. A smoking article as produced by the process of claim 1, wherein the first burn promoting agent and the second burn promoting agent comprise a material selected from the group consisting of an acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, and mixtures thereof.

5. A smoking article as produced by the process of claim 1, wherein the first burn promoting agent and the second burn promoting agent comprise a citrate, a succinate, or mixtures thereof.

6. A smoking article as produced by the process of claim 1, wherein the treated areas are constructed so as to cause the smoking article to self extinguish when the smoking article is lit and placed against an adjacent surface, the treated areas, however, also being constructed so that the smoking article will not self extinguish if left in a free air burning state.

7. A smoking article as produced by the process of claim 1, wherein the treated areas have a permeability of less than about 40 Coresta.

8. A smoking article as produced by the process of claim 1, wherein the treated areas have a BMI of less than about 5 $cm^{-1}$.

9. A smoking article as produced by the process of claim 1, wherein the treated areas are printed onto the paper wrapper.

10. A smoking article as produced by the process of claim 1, wherein the untreated areas of the paper wrapper have a permeability of greater than about 30 Coresta.

11. A smoking article as produced by the process of claim 1, wherein the treated areas comprise a plurality of discrete circumferential bands disposed longitudinally along the smoking article.

12. A smoking article as produced by the process of claim 11, wherein the bands are spaced from each other at a distance of from about 5 mm to about 50 mm, the bands having a width of greater than about 3 mm.

13. A smoking article as produced by the process of claim 1, wherein the treated areas have a permeability of less than about 25 Coresta and a BMI of less than about 3 $cm^{-1}$.

14. A smoking article as produced by the process of claim 1, wherein the paper wrapper has a basis weight of from about 18 gsm to about 60 gsm.

15. A smoking article as produced by the process of claim 1, wherein the treated areas are treated with a particulate inorganic filler.

16. A smoking article as produced by the process of claim 1, wherein the treated areas have a permeability of less than about 18 Coresta.

17. A smoking article as produced by the process of claim 1, wherein an aqueous composition comprises the film-forming material prior to being applied to the paper wrapper.

18. A smoking article as produced by the process of claim 1, wherein a non-aqueous composition comprises the film-forming material prior to being applied to the paper wrapper.

19. A smoking article as produced by the process of claim 1, wherein the untreated areas of the paper wrapper have a permeability of greater than about 80 Coresta.

20. A smoking article as produced by the process of claim 1, wherein the first burn promoting agent is present within the treated areas in an amount from about 0.1% to about 5% by weight.

21. A smoking article as produced by the process of claim 1, wherein the first burn promoting agent is present within the treated areas in an amount from about 1% to about 3% by weight.

22. A paper wrapper for a smoking article that provides the smoking article with reduced ignition proclivity characteristics produced by a process comprising the steps of:

providing an untreated paper web designed to surround a smokable filler;

treating discrete areas of the paper web by directly applying a film-forming composition to the discrete of the paper wrapper, the film-forming composition; being free of a burn retardant; and applying a burn promoting agent only to untreated areas of the paper web, the untreated areas being free of the film-forming composition;

wherein the treated areas containing the film-forming composition are separated by the untreated areas containing the burn promoting agent, the film-forming composition comprising a material selected from the group consisting of an alginate, a guar gum, a pectin, a polyvinyl alcohol, a cellulose derivative, a starch, a starch derivative, and mixtures thereof, the treated areas having a permeability of less than about 25 Coresta and a BMI of less than about 5 $cm^{-1}$, the paper web having a basis weight of from about 18 gsm to about 60 gsm.

23. A paper wrapper as produced by the process of claim 22, wherein the burn promoting agent comprises an alkali metal salt, an alkaline earth metal salt, or mixtures thereof.

24. A paper wrapper as produced by the process of claim 22, wherein the burn promoting agent comprises acetic acid salt, a citric acid salt, a malic acid salt, a lactic acid salt, a tartaric acid salt, a carbonic acid salt, a formic acid salt, a propionic acid salt, a glycolic acid salt, a fumaric acid salt, an oxalic acid salt, a malonic acid salt, a succinic acid salt, a nitric acid salt, a phosphoric acid salt, or mixtures thereof.

25. A paper wrapper as produced by the process of claim 22, wherein the burn promoting agent comprises a citrate, a succinate, or mixtures thereof.

26. A paper wrapper as produced by the process of claim 22, wherein the treated areas have a BMI of less than about 5 $cm^{-1}$.

27. A paper wrapper as produced by the process of claim 22, wherein the treated areas are printed onto the paper wrapper.

28. A paper wrapper as produced by the process of claim 22, wherein the treated areas comprise a plurality of discrete circumferential bands disposed longitudinally along the smoking article.

29. A paper wrapper as produced by the process of claim 28, wherein the bands are spaced from each other at a distance of from about 5 mm to about 50 mm, the bands having a width of greater than about 3 mm.

* * * * *